US010561233B1

(12) United States Patent
Lin

(10) Patent No.: US 10,561,233 B1
(45) Date of Patent: Feb. 18, 2020

(54) WORKSTATION WITH PNEUMATIC HEIGHT ADJUSTABLE DESK

(71) Applicants: Yi-Chen Tseng, Taichung (TW); HI-MAX INNOVATION CO., LTD., Taichung (TW)

(72) Inventor: Jhih-Fan Lin, Taichung (TW)

(73) Assignee: Hi-Max Innovation Co., Ltd., Taichung (TW)

( * ) Notice: Subject to any disclaimer, the term of this patent is extended or adjusted under 35 U.S.C. 154(b) by 0 days.

(21) Appl. No.: 16/220,140

(22) Filed: Dec. 14, 2018

(51) Int. Cl.

| | |
|---|---|
| ***A47B 9/10*** | (2006.01) |
| ***A47B 9/12*** | (2006.01) |
| ***A47B 21/02*** | (2006.01) |
| ***A47B 9/20*** | (2006.01) |
| *A47B 9/02* | (2006.01) |

(52) U.S. Cl.
CPC ..... *A47B 9/10* (2013.01); *A47B 9/12* (2013.01); *A47B 9/20* (2013.01); *A47B 21/02* (2013.01); *A47B 9/02* (2013.01)

(58) Field of Classification Search
CPC ..... A47B 9/02; A47B 9/20; A47B 2009/046; A47B 2009/0453; A47B 21/02; A47B 2009/043
USPC ..... 108/147, 147.19, 50.01, 50.02; 248/188.5, 188.2, 404
See application file for complete search history.

(56) References Cited

U.S. PATENT DOCUMENTS

| | | | | | |
|---|---|---|---|---|---|
| 3,802,002 | A * | 4/1974 | Jonas | A61G 7/005 | 5/611 |
| 4,615,279 | A * | 10/1986 | de la Haye | A47B 9/04 | 108/147 |
| 4,762,072 | A * | 8/1988 | Boundy | A47B 21/06 | 108/50.02 |
| 5,265,952 | A * | 11/1993 | Greshem | A47B 83/001 | 108/147 |
| 5,373,793 | A * | 12/1994 | Crossman | A47B 9/04 | 108/42 |
| 5,408,940 | A * | 4/1995 | Winchell | A47B 9/06 | 108/10 |
| 5,743,193 | A * | 4/1998 | Kakuta | A47B 21/02 | 108/106 |
| 6,286,441 | B1 * | 9/2001 | Burdi | A47B 9/00 | 108/147 |
| 6,412,427 | B1 * | 7/2002 | Merkt | A47B 9/12 | 108/147 |
| 6,595,144 | B1 * | 7/2003 | Doyle | A47B 9/00 | 108/147 |
| 7,398,738 | B2 * | 7/2008 | Newhouse | A47B 9/18 | 108/147 |
| 7,412,931 | B2 * | 8/2008 | Seidl | A47B 9/02 | 108/147 |
| 8,104,410 | B2 * | 1/2012 | Lanfear | A47B 9/20 | 108/13 |

(Continued)

*Primary Examiner* — Jose V Chen
(74) *Attorney, Agent, or Firm* — Wang Law Firm, Inc.

(57) ABSTRACT

A workstation includes a partition unit to form a workspace, in which a desk board, two pneumatic devices and a synchronizing device are provided. Each of the pneumatic devices has a fixed section and a movable section while the fixed section is fixed to the partition unit and the movable section is connected to desk board to lift and lower the desk board. The synchronizing device is connected to the pneumatic devices to synchronize movements of the pneumatic devices.

8 Claims, 13 Drawing Sheets

(56) References Cited

U.S. PATENT DOCUMENTS

| | | | | |
|---|---|---|---|---|
| 8,529,001 | B2 * | 9/2013 | Calvillo | F25D 25/02 312/408 |
| 9,038,549 | B1 * | 5/2015 | Zebarjad | A47B 9/02 108/147 |
| 9,635,932 | B2 * | 5/2017 | Kelley | A47B 21/06 |
| 9,999,295 | B1 * | 6/2018 | Game | A47B 21/04 |
| 10,004,329 | B2 * | 6/2018 | Nourse | A47B 21/06 |
| 10,136,724 | B2 * | 11/2018 | Smed | A47B 9/20 |
| 10,448,731 | B2 * | 10/2019 | Atkins | A47B 9/20 |
| 2008/0178779 | A1 * | 7/2008 | Agee | A47B 9/04 108/147 |
| 2012/0227642 | A1 * | 9/2012 | Sekikawa | A47B 9/10 108/147 |
| 2015/0320198 | A1 * | 11/2015 | Zebarjad | A47B 9/00 108/147 |
| 2016/0037907 | A1 * | 2/2016 | Ergun | A47B 9/12 108/147 |
| 2016/0088930 | A1 * | 3/2016 | Hansen | F16F 9/0245 108/147 |

* cited by examiner

WORKSTATION WITH PNEUMATIC HEIGHT ADJUSTABLE DESK

BACKGROUND OF THE INVENTION

1. Technical Field

The present invention relates to office furniture, and more particularly to a workstation with a pneumatic height adjustable desk.

2. Description of Related Art

Typically, a conventional workstation for office has a partition unit and a desk. The partition unit usually has three partitions to enclose a workspace, and the desk is provided in the workspace. Precisely, the partitions include a front member and two lateral members connected to opposite ends of the front member. The desk has a desk board fixed to the partitions. A drawback of such workstation is that a height of the desk board is fixed after the workstation is set.

An improved workstation has a partition unit and a height adjustable desk provided in a workspace of the partition unit. In such workstation the partition unit and the height adjustable desk are two independent elements without any connection. Furthermore, the height adjustable desk has at least two legs in the workspace, which narrows the space under the desk board.

BRIEF SUMMARY OF THE INVENTION

In view of the above, the primary objective of the present invention is to provide a workstation, which is equipped with a pneumatic height adjustable desk.

The secondary objective of the present invention is to provide a workstation, which has pneumatic lifting devices to lift and lower the desk board, and the lifting devices are fixed to the partitions to enlarge the space under the desk board.

In order to achieve the objective of the present invention, a workstation includes a front partition member having a first end and a second end opposite to the first end; a first wall member and a second wall member connected to the first end and the second end of the front partition member to enclose a workspace; a desk board provided in the workspace; a first pneumatic device fixed to the first wall member and connected to the desk board; a second pneumatic device fixed to the second wall member and connected to the desk board; a mounting base connected to the desk board and between the first pneumatic device and the second pneumatic device; and a synchronizing device received in the mounting base and connected to the first pneumatic device and the second pneumatic device respectively.

The desk board is lifted and lowered by the first pneumatic device and the second pneumatic device, and the synchronizing device synchronizes movements of the first pneumatic device and the second pneumatic device.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
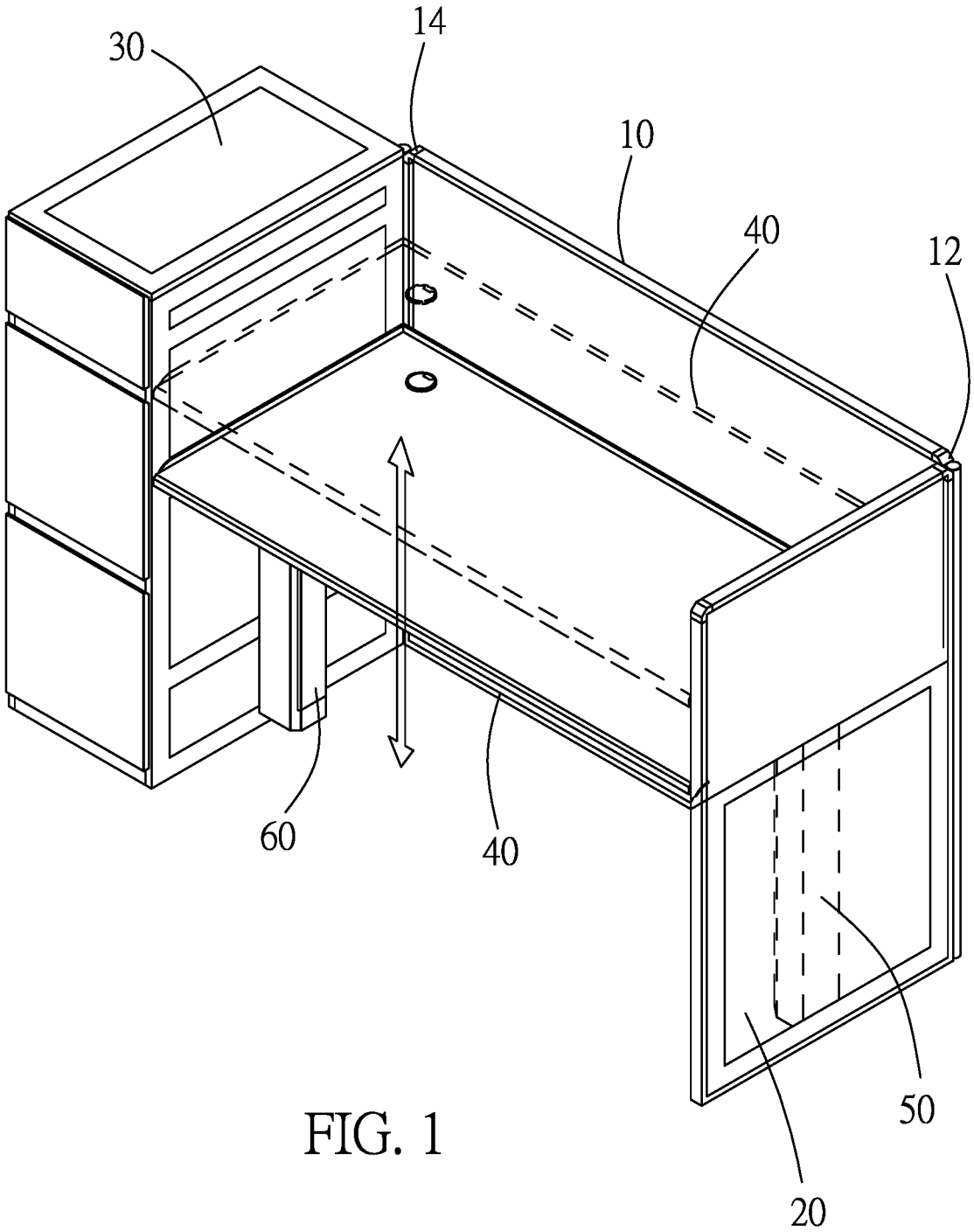
FIG. 1 is a perspective view of a preferred embodiment of the present invention.

FIG. 1 shows a workstation 1 of the first preferred embodiment of the present invention, including a front partition member 10, a first wall member 20, and a second wall member 30. The front partition member 10 has a first end 12 and a second end 14 opposite to the first end 12. The first wall member 20 is connected to the first end 12 of the front partition member 10 while the second wall member 30 is connected to the second end 14. The first and the second wall members 20 and 30 are perpendicular to the front partition member 10 to enclose a workspace therewithin. In the first preferred embodiment, the front partition member 10 and the first wall member 20 are two boards, and the second wall member 30 is a cabinet.

The workstation 1 further includes a desk board 40, a first pneumatic device 50 and a second pneumatic device 60. The desk board 40 is received in the workspace while the first pneumatic device 50 is fixed to the first wall member 20 and the second pneumatic device 60 is fixed to the second wall member 30. Both of the first and the second pneumatic devices 50 and 60 are connected to a bottom of the desk board 40 to lift and lower the desk board 40.

Figure 2:
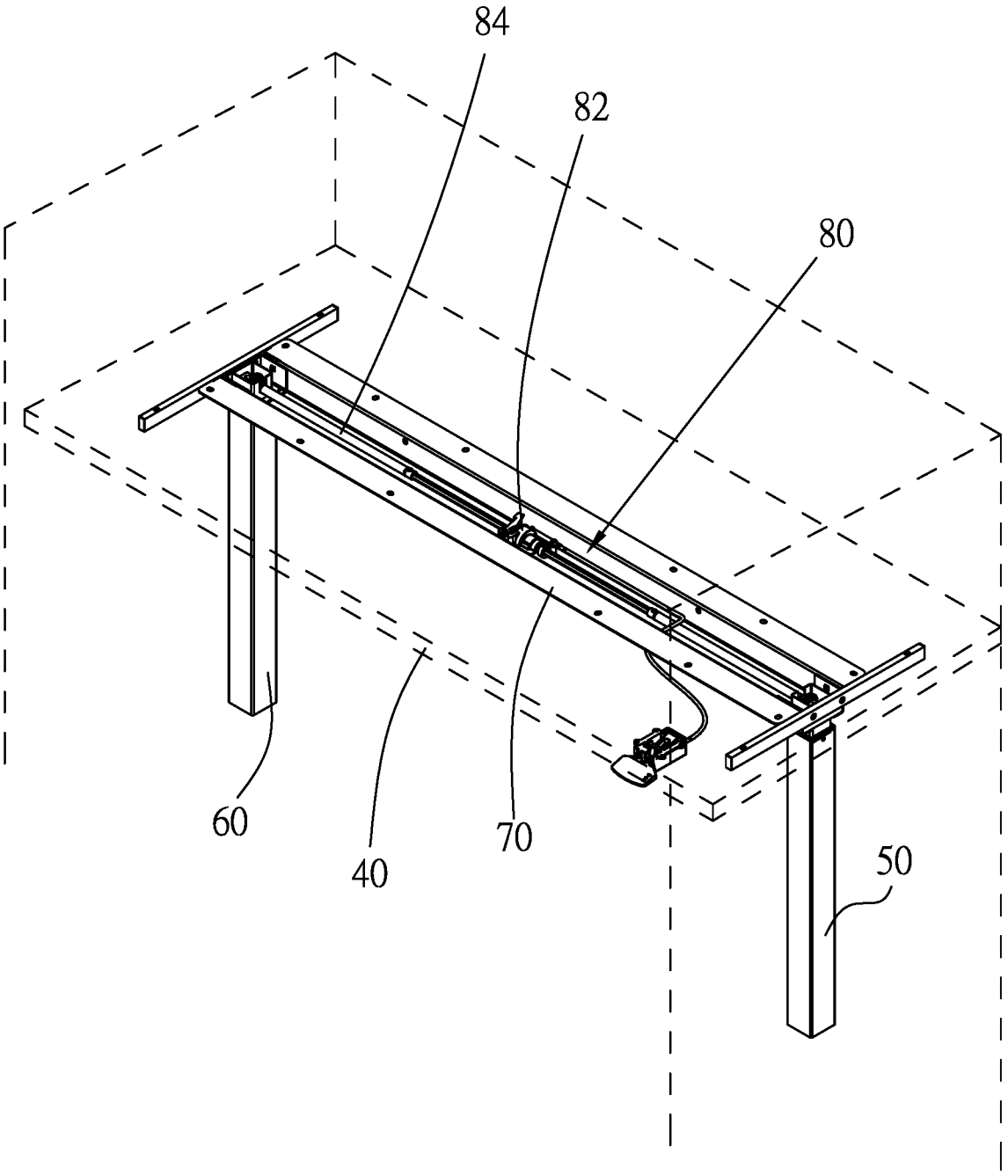
FIG. 2 is another perspective view of the preferred embodiment of the present invention.

As shown in FIG. 2, a mounting base 70 is provided on the bottom of the desk board 40 between the first and the second pneumatic devices 50 and 60, in which a synchronizing device 80 is provided. The synchronizing device 80 is connected to the first and the second pneumatic devices 50 and 60 respectively.

Figure 3:
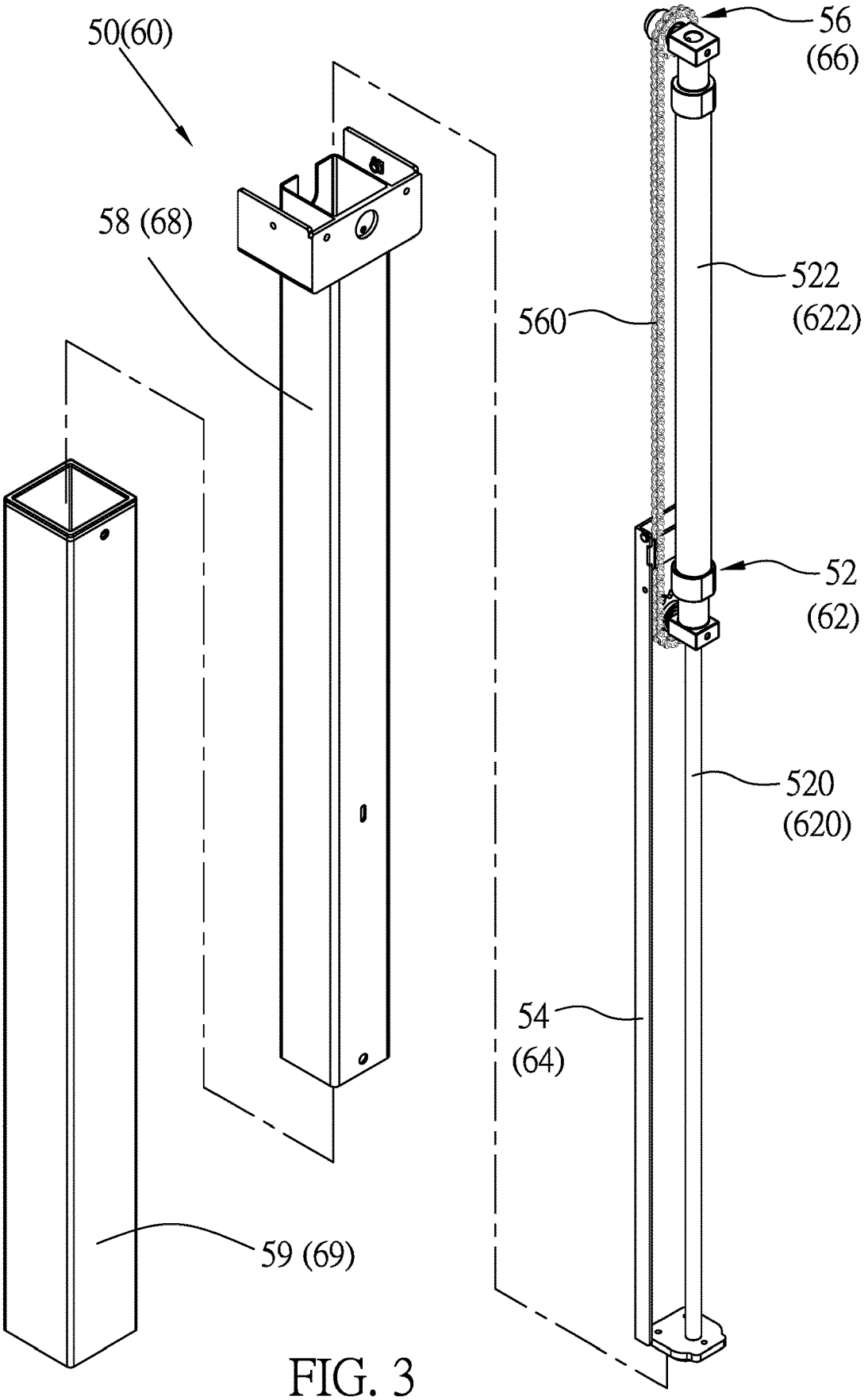
FIG. 3 is an exploded view of the pneumatic device of the preferred embodiment of the present invention.

As shown in FIG. 3, the first pneumatic device 50 includes a first pneumatic member 52, a first positioning board 54, a first transmission member 56, a first inner tube 58, and a first outer tube 59. The first pneumatic member 52 has a first fixed section 520 and a first movable section 522, and the first movable section 522 is fitted to the first fixed section 520 to be moved relative to the first fixed section 520. In the present preferred embodiment, the first pneumatic member 52 is a pneumatic valve. The second pneumatic device 60 includes a second pneumatic member 62, a second positioning board 64, a second transmission member 66, a second inner tube 68, and a second outer tube 69. The second pneumatic member 62 has a second fixed section 60 and a second movable section 622, and the second movable section 622 is fitted to the second fixed section 60 to be moved relative to the second fixed section 620. In the present preferred embodiment, the second pneumatic member 62 is a pneumatic valve.

Figure 4:
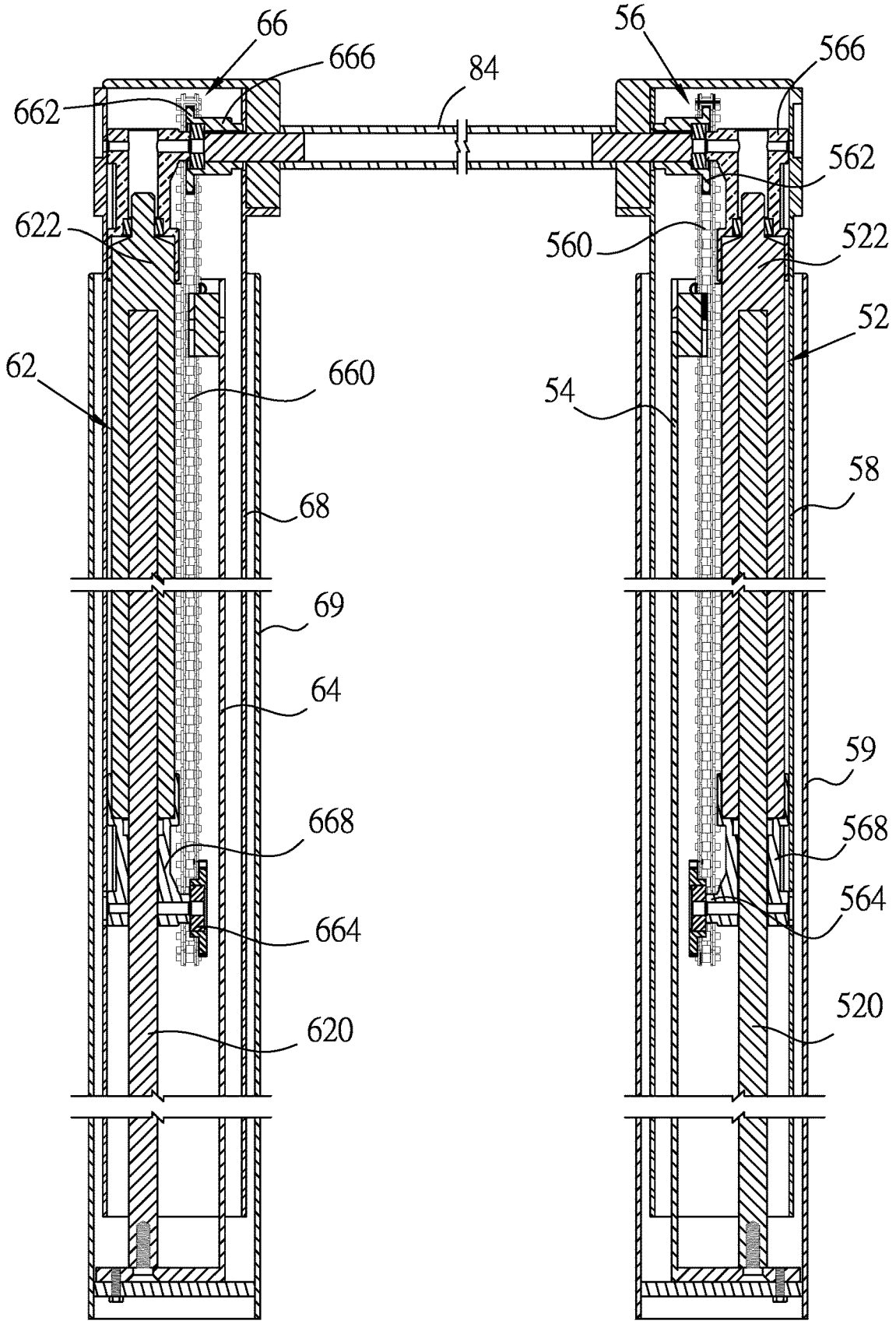
FIG. 4 is a sectional view of the pneumatic device of the preferred embodiment of the present invention.

As shown in FIG. 4, the first transmission member 56 includes a transmission chain 560 and a pair of gears 562 and 564. The gears 562 and 564 are connected to opposite ends of the first movable section 522 respectively. Precisely, the gears 562 and 564 are pivoted the first movable section 522 through two gear bases 566 and 568. Axes of rotation of the gears 562 and 564 are perpendicular to an axial direction of the first movable section 522. The transmission chain 560 engages the gears 562 and 564, and is connected to the first positioning board 54. An end of the first fixed section 520 passes through the gear base 568 and enters the first movable section 522, and the other end thereof is fixed to the first positioning board 54.

The first pneumatic member 52, the first positioning board 54, and the first transmission member 56 are received in the first inner tube 58, and the first pneumatic member 52, the first positioning board 54, the first transmission member 56, and the first inner tube 58 are received in the first outer tube 59. An end of the first outer tube 59 is connected to the first positioning board 54 by a connector. As a result, the first inner tube 58 is moved by the first pneumatic member 52 relative to the outer tube 59.

The second transmission member 66 includes a transmission chain 660 and a pair of gears 662 and 664. The gears 662 and 664 are connected to opposite ends of the second movable section 622 respectively. Precisely, the gears 662 and 664 are connected to the second movable section 622 through two gear bases 666 and 668. Axes of rotation of the gears 662 and 664 are perpendicular to an axial direction of the second movable section 622. The transmission chain 660 engages the gears 662 and 664, and is connected to the second positioning board 64. An end of the second fixed section 620 passes through the gear base 668 and enters the second movable section 622, and the other end thereof is fixed to the second positioning board 64.

The second pneumatic member 62, the second positioning board 64, and the second transmission member 66 are received in the second inner tube 68, and the second pneumatic member 62, the second positioning board 64, the second transmission member 66, and the second inner tube 68 are received in the second outer tube 69. An end of the second outer tube 69 is connected to the second positioning board 64 by a connector. As a result, the second inner tube 68 is moved by the second pneumatic member 62 relative to the outer tube 69.

Figure 5:
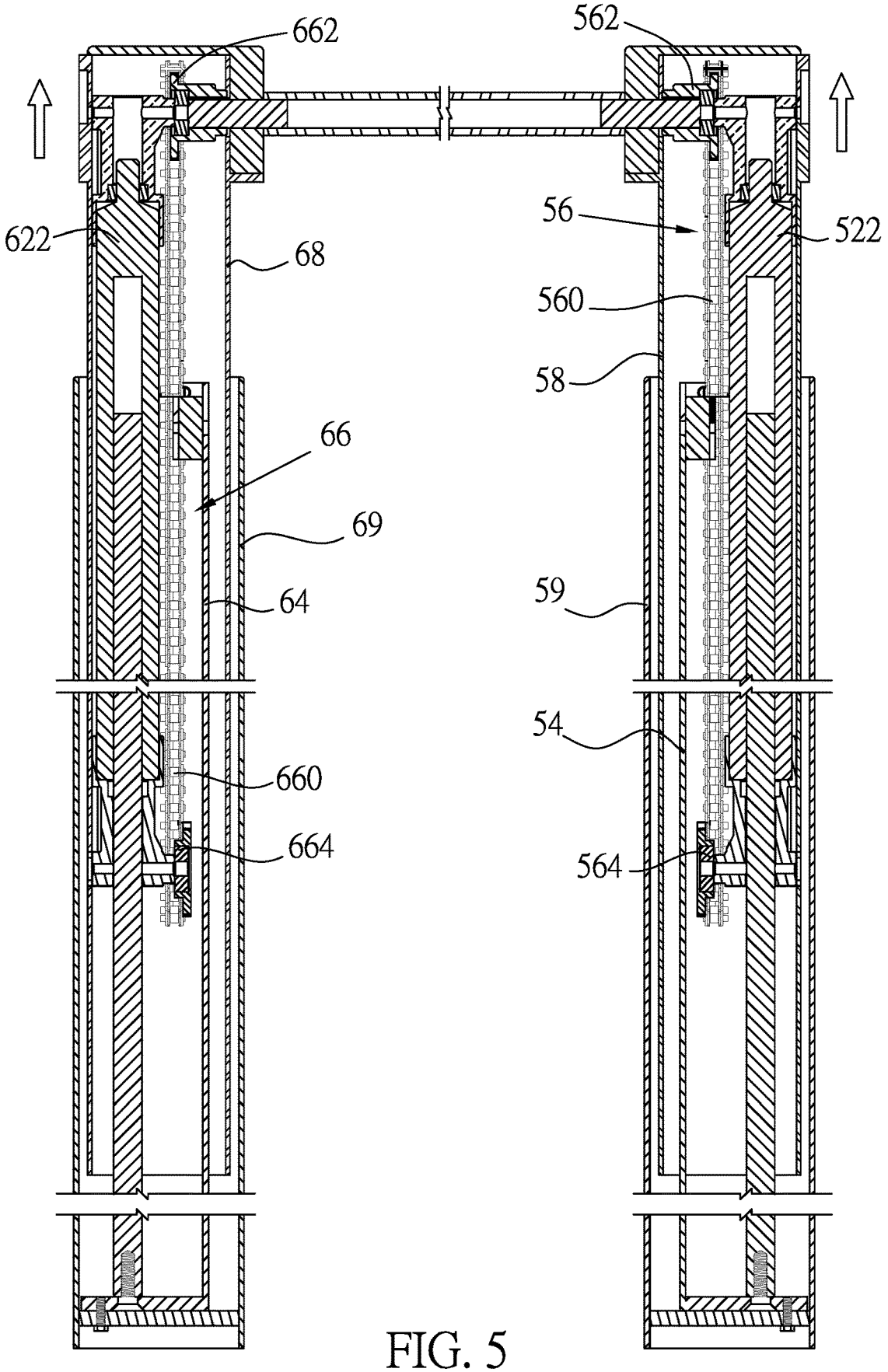
FIG. 5 is another sectional view of the pneumatic device of the preferred embodiment of the present invention, showing the pneumatic devices extending.

As shown in FIG. 5, the first inner tube 58 is moved upwards, and the first outer tube 59 and the first positioning board 54 stay still while the first transmission member 56 and the first movable section 522 move upwards. At this time, the gears 562 and 564 are turned by the chain 560 since the first movable section 522 moves relative to the first positioning board 54 and the chain 560 is connected to the first positioning board 54. The same situation is occurred in the second pneumatic device 60, the second inner tube 68 is moved upwards, and the second outer tube 69 and the second positioning board 64 stay still while the second transmission member 66 and the second movable section 622 move upwards. At this time, the gears 662 and 664 are turned by the chain 660 since the second movable section 622 moves relative to the second positioning board 64 and the chain 660 is connected to the second positioning board 64.

As shown in FIG. 2, the synchronizing device 80 includes a clutch member 82 and an axle 84, and the axle 84 passes through the clutch member 82 with opposite ends connected to the first pneumatic device 50 and the second pneumatic device 60.

Figure 6:
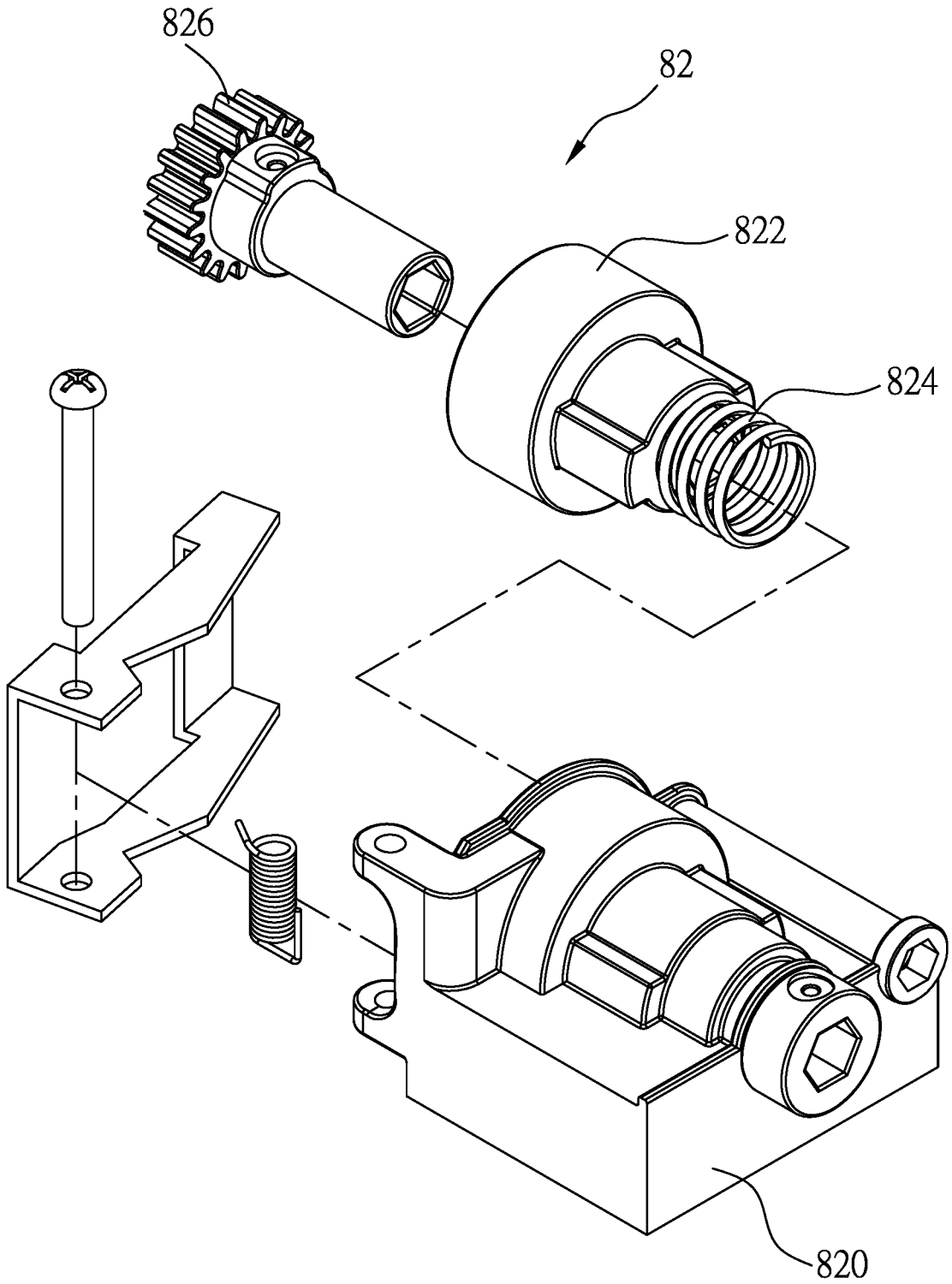
FIG. 6 is an exploded view of the clutch member of the preferred embodiment of the present invention.
Figure 7:
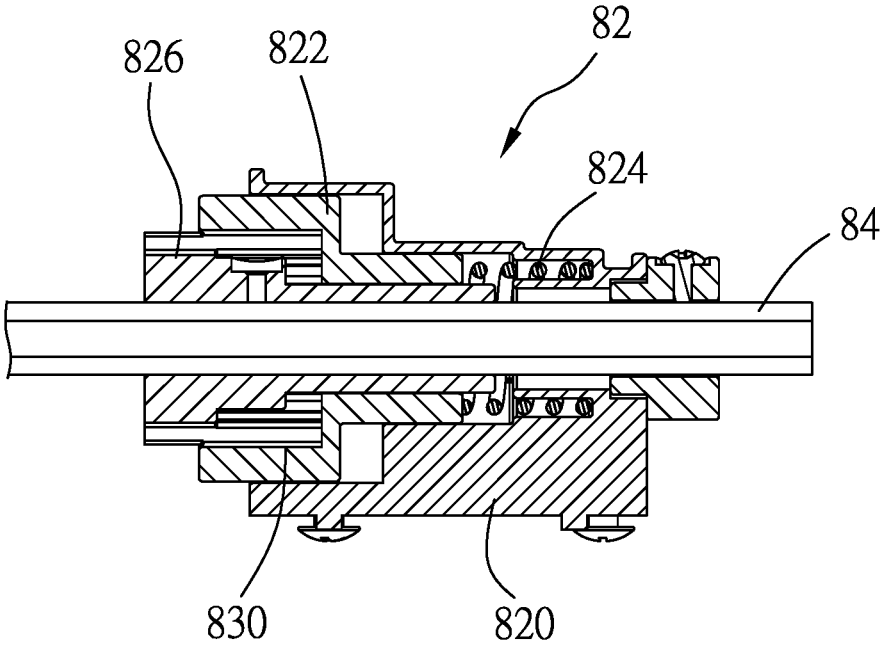
FIG. 7 is a sectional view of the clutch member of the preferred embodiment of the present invention.
Figure 8:
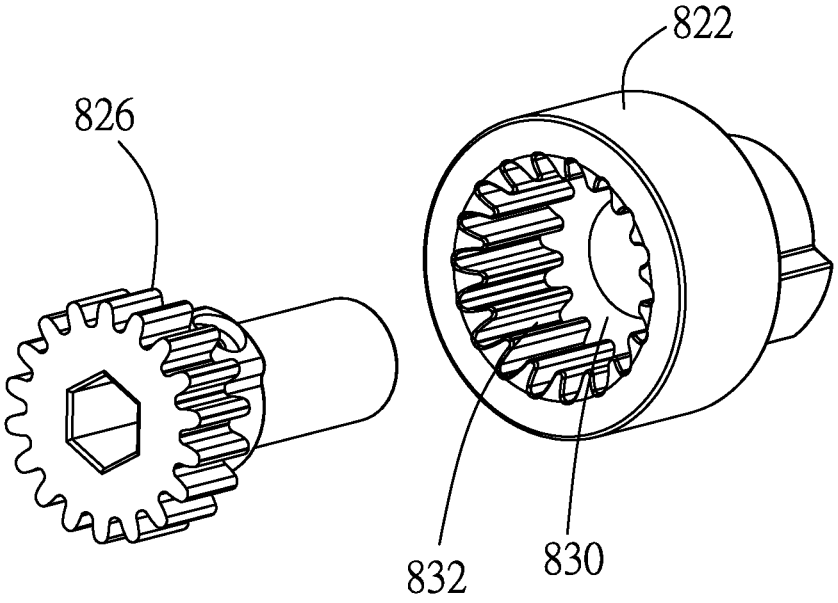
FIG. 8 is an exploded view of the preferred embodiment of the present invention, showing the inner base and a part of the clutch member.

As shown in FIG. 6 and FIG. 7, the clutch member 82 includes an outer base 820, an inner base 822, a spring 824, and a clutch gear 826. The inner base and the spring 824 are received in the outer base 820 while the spring 824 has opposite ends thereof abutting against the outer base 820 and the inner base 822. As shown in FIG. 8, the inner base 822 has a bore 830 with teeth 832 on a sidewall thereof, and the clutch gear 826 is received in the bore 830. As shown in FIG. 7, the axle 84 passes through the outer base 820, the spring 824, the clutch gear 826 and the bore 830 of the inner base 822 in sequence.

Figure 9:
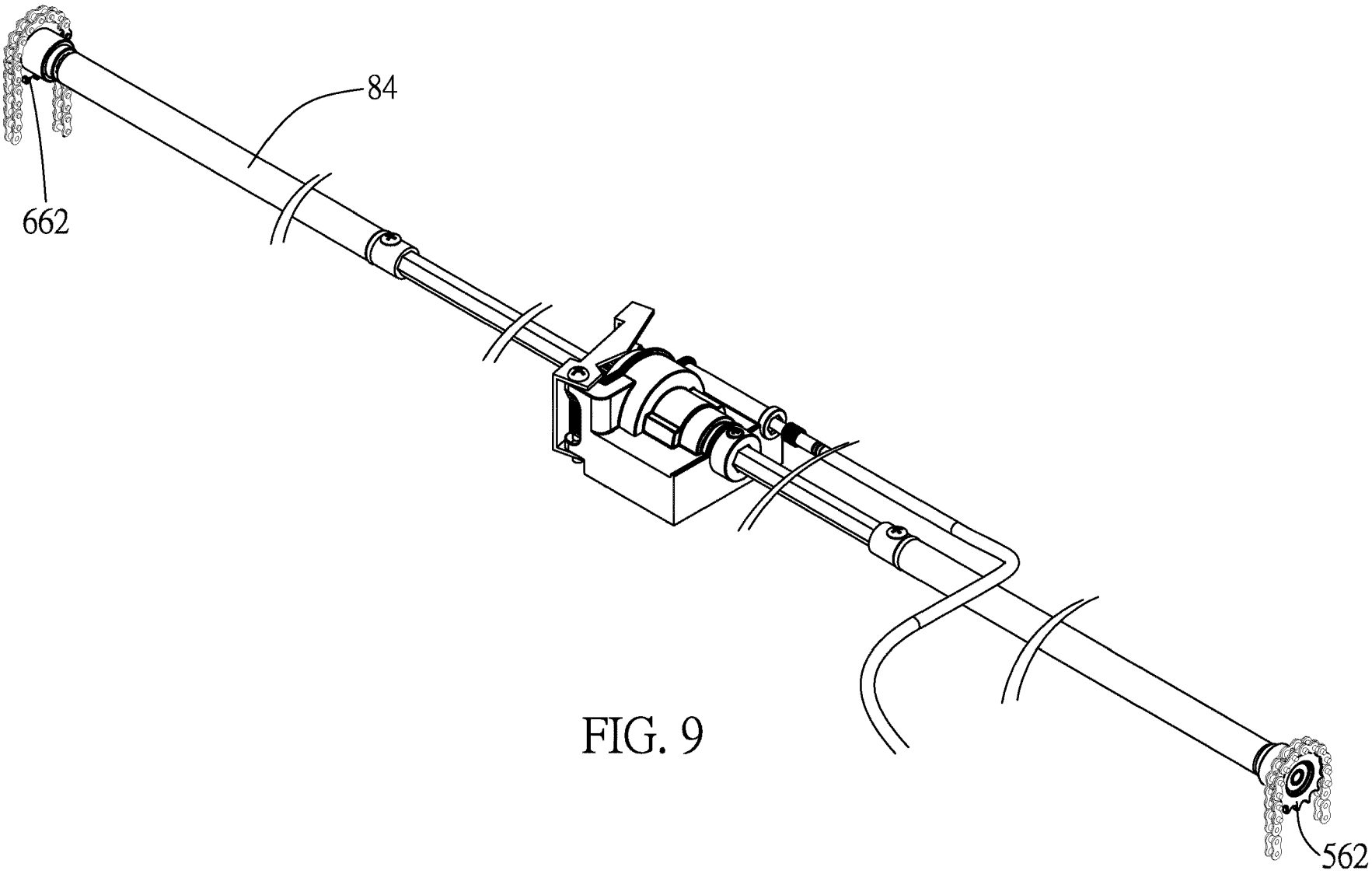
FIG. 9 is a perspective view of the preferred embodiment of the present invention, showing the axle and the gears.

As shown in FIG. 9 and FIG. 4, the opposite ends of the axle 84 are connected to the gear 562 on the first movable section 522 and the gear 662 on the second movable section 622.

Figure 10:
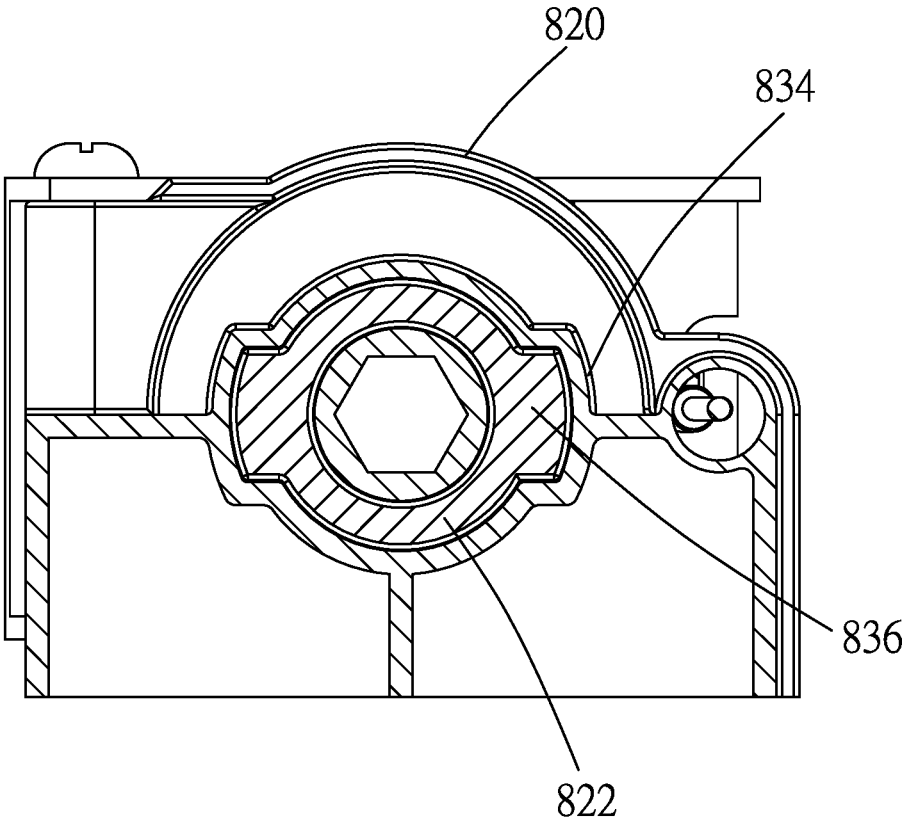
FIG. 10 is another sectional view of the clutch member of the preferred embodiment of the present invention.
Figure 11:
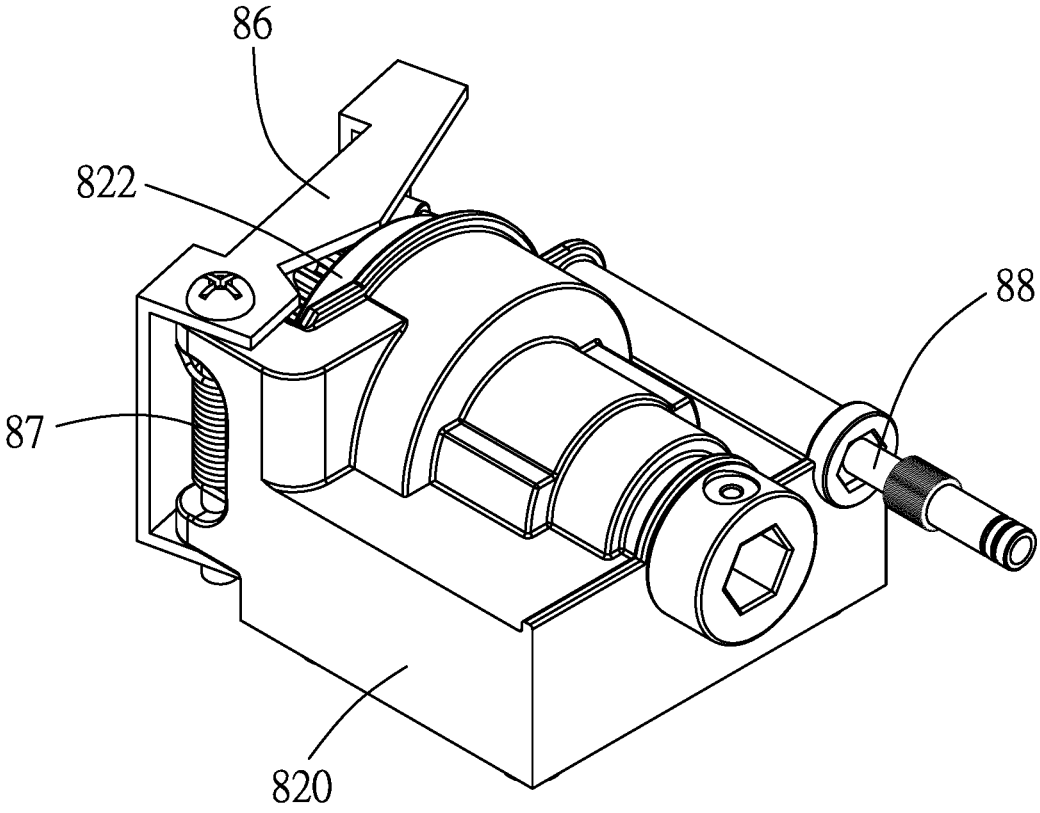
FIG. 11 is a perspective view of the clutch member of the preferred embodiment of the present invention.

As shown in FIG. 10, the outer base 820 is provided with a slot 824 on an interior side thereof, and the inner base 822 is provided with a protrusion 836 on an exterior side thereof. The protrusion 836 engages the slot 824 while the inner base 822 is received in the outer base 820. As shown in FIG. 11, a pressing member 86 and a spring 87 are provided to the outer base 820. The spring 87 urges the pressing member 86 to press the inner base 822. A wire 88 has an end fastened to the pressing member 86.

Figure 12:
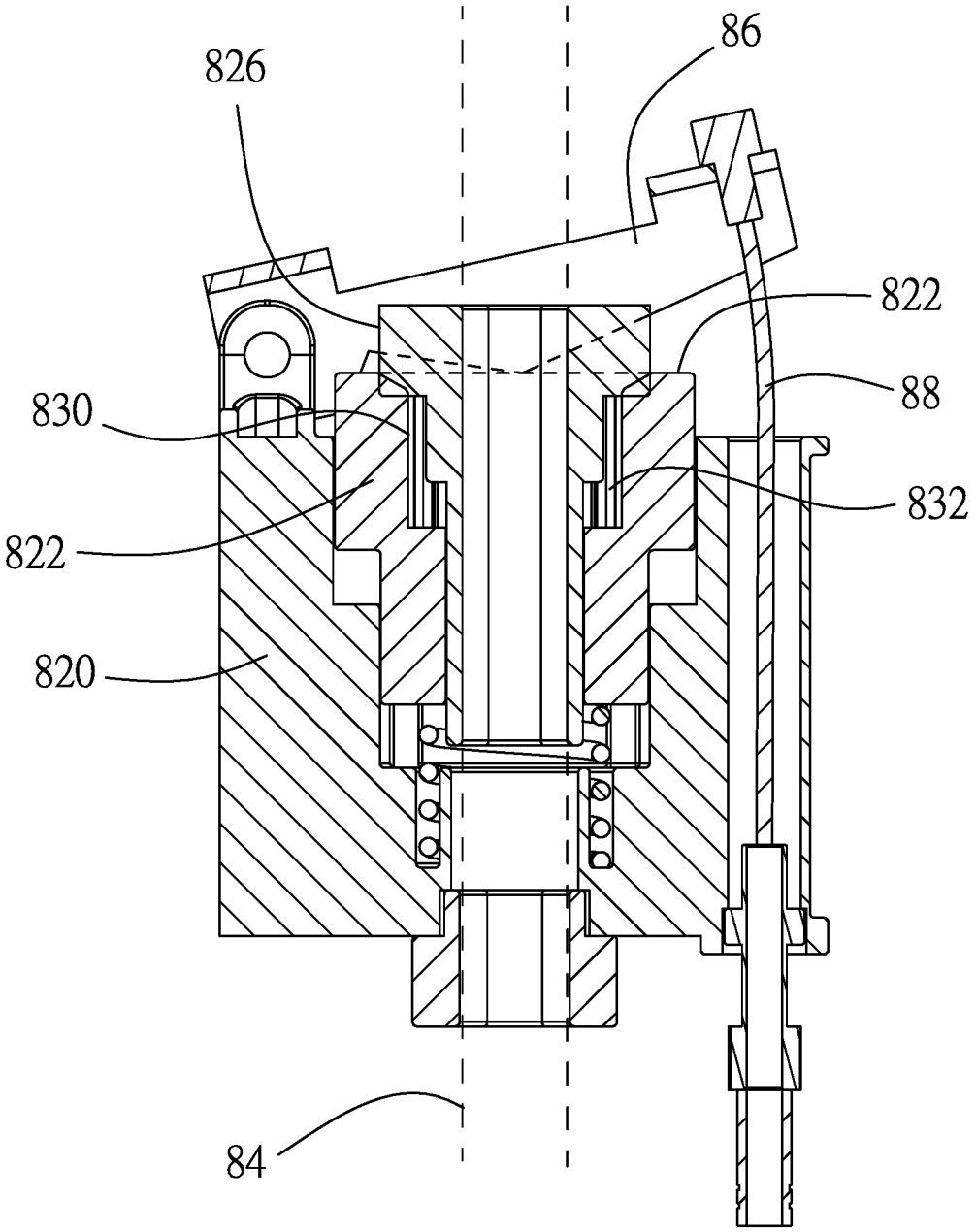
FIG. 12 and FIG. 13 are sectional views of the clutch member of the preferred embodiment of the present invention, showing the working of the clutch member.
Figure 13:
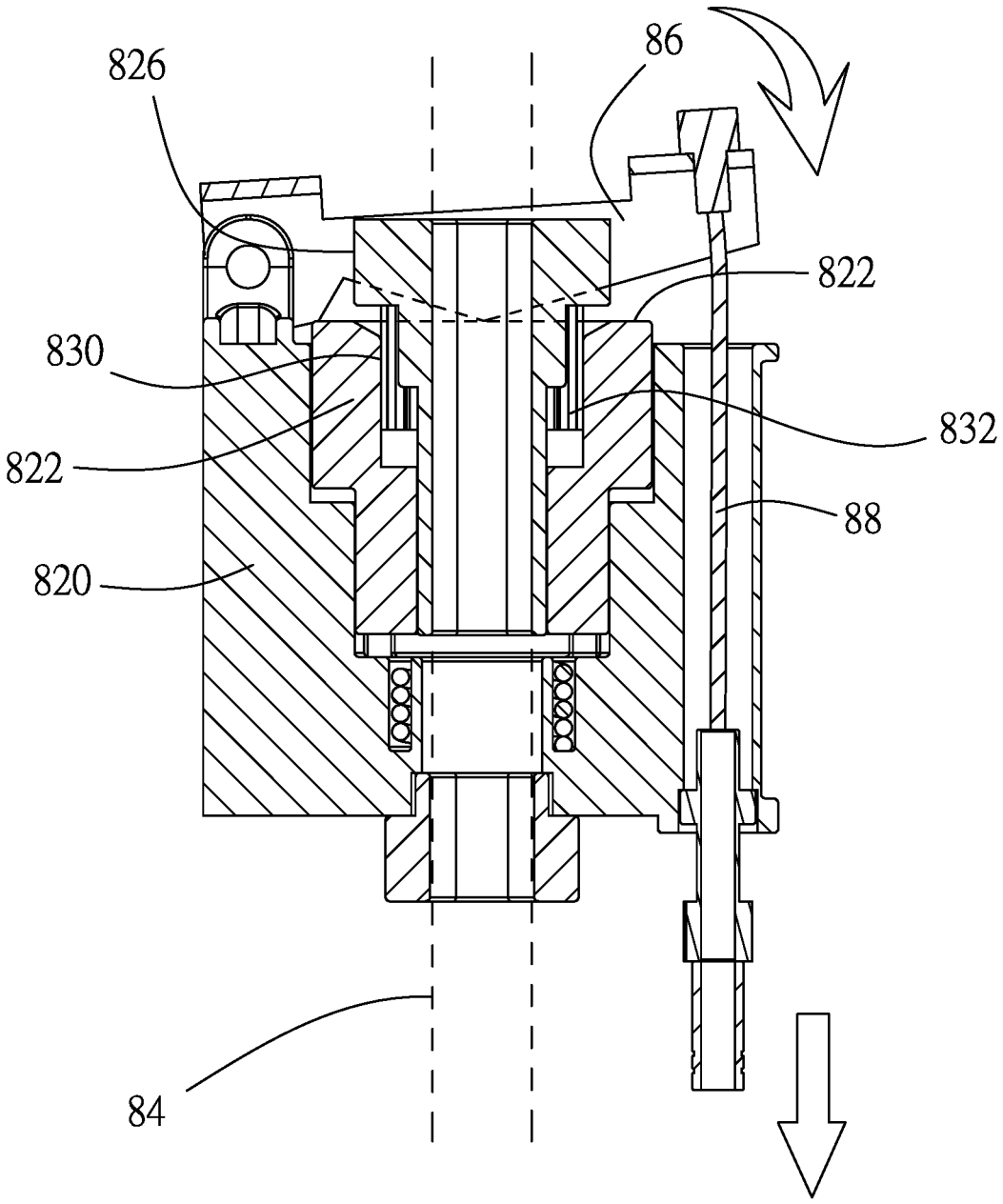

As shown in FIG. 12 and FIG. 13, the wire 88 is pulled to move the pressing member 86 so as to move the inner base 822 away from the outer base 820 and to disengage the clutch gear 826 with the teeth 832 of the inner base 822. As a result, the axle 84 is free to rotate, and the first pneumatic device 50 and the second pneumatic device 60 are free to extend and shorten. When the wire 88 is released, the inner base 822 will return to its initial position by the spring 87 to engage the clutch gear 826 with the teeth 832 of the inner base 822. As a result, the axle 84 is unable to rotate and the first pneumatic device 50 and the second pneumatic device 60 are fixed.

In conclusion, when a user pulls the wire 88, it could free the first pneumatic device 50 and the second pneumatic device 60 to lift and lower the desk board 40, and the user only needs to release wire 88 to fix the desk board 40 when the desk board 40 is moved to a desired height. Furthermore, the gear 562 on the first movable section 522 and the gear 662 on the second movable section 622 are synchronously turned by the axle 84, so that it could prevent the desk board 40 from tilting because the first pneumatic device 50 and the second pneumatic device 60 move asynchronously.

It must be pointed out that the embodiments described above are only some preferred embodiments of the present invention. All equivalent structures which employ the concepts disclosed in this specification and the appended claims should fall within the scope of the present invention.

What is claimed is:

1. A workstation, comprising:

a front partition member having a first end and a second end opposite to the first end;

a first wall member and a second wall member connected to the first end and the second end of the front partition member respectively to enclose a workspace;

a desk board provided in the workspace;

a first pneumatic device fixed to the first wall member and connected to the desk board;

a second pneumatic device fixed to the second wall member and connected to the desk board;

a mounting base connected to the desk board and between the first pneumatic device and the second pneumatic device; and a synchronizing device received in the mounting base and connected to the first pneumatic device and the second pneumatic device respectively;

wherein the desk board is lifted and lowered by the first pneumatic device and the second pneumatic device, and the synchronizing device synchronizes movements of the first pneumatic device and the second pneumatic device wherein the first pneumatic device includes a first pneumatic member, a first positioning board, a first transmission member, a first inner tube, and a first outer tube; the first pneumatic member has a first fixed section and a first movable section movably engaging the first fixed section; the first transmission member has a chain and a pair of gears; the gears are pivoted on the first movable section, and the transmission chain engages the gears; the transmission chain is connected to the first positioning board; the first pneumatic member, the first positioning board, and the first transmission member are received in the first inner tube, and the first inner tube is received in the first outer tube with the first positioning board connected to the first outer tube; one of the gears on the first movable section is connected to the synchronizing device.

2. The workstation of claim 1, wherein at least one of the first wall member and the second wall member is a board.

3. The workstation of claim 1, wherein the synchronizing device includes a clutch member and an axle; the axle passes through the clutch member with opposite ends connected to the first pneumatic device and the second pneumatic device.

4. The workstation of claim 1, wherein the synchronizing device includes a clutch member and an axle; the clutch member includes an outer base, an inner base, a spring, and a clutch gear; the inner base and the spring are received in the outer base while the spring has opposite ends thereof abutting against the outer base and the inner base; the inner base has a bore with teeth on a sidewall thereof, and the clutch gear is received in the bore; the axle passes through the outer base, the spring, the clutch gear and the bore of the inner base and has opposite ends connected to the gear on the first movable section and the second pneumatic device respectively; the inner base is moved to engage and disengage the clutch gear with the teeth of the inner base.

5. The workstation of claim 4, wherein the outer base is provided with a slot on an interior side thereof, and the inner base is provided with a protrusion on an exterior side thereof; the protrusion engages the slot while the inner base is received in the outer base.

6. A workstation, comprising:

a front partition member having a first end and a second end opposite to the first end;

a first wall member and a second wall member connected to the first end and the second end of the front partition member respectively to enclose a workspace;

a desk board provided in the workspace;

a first pneumatic device fixed to the first wall member and connected to the desk board;

a second pneumatic device fixed to the second wall member and connected to the desk board;

a mounting base connected to the desk board and between the first pneumatic device and the second pneumatic device; and a synchronizing device received in the mounting base and connected to the first pneumatic device and the second pneumatic device respectively;

wherein the desk board is lifted and lowered by the first pneumatic device and the second pneumatic device, and the synchronizing device synchronizes movements of the first pneumatic device and the second pneumatic device;

wherein the second pneumatic device includes a second pneumatic member, a second positioning board, a second transmission member, a second inner tube, and a second outer tube; the second pneumatic member has a second fixed section and a second movable section movably engaging the second fixed section; the second transmission member has a chain and a pair of gears; the gears are pivoted on the second movable section, and the transmission chain engages the gears; the transmission chain is connected to the second positioning board; the second pneumatic member, the second positioning board, and the second transmission member are received in the second inner tube, and the second inner tube is received in the second outer tube with the second positioning board connected to the second outer tube; one of the gears on the second movable section is connected to the synchronizing device.

7. The workstation of claim 6, wherein the synchronizing device includes a clutch member and an axle; the clutch member includes an outer base, an inner base, a spring, and a clutch gear; the inner base and the spring are received in the outer base while the spring has opposite ends thereof abutting against the outer base and the inner base; the inner base has a bore with teeth on a sidewall thereof, and the clutch gear is received in the bore; the axle passes through the outer base, the spring, the clutch gear and the bore of the inner base and has opposite ends connected to the first pneumatic device and the gear on the second movable section respectively; the inner base is moved to engage and disengage the clutch gear with the teeth of the inner base.

8. The workstation of claim 7, wherein the outer base is provided with a slot on an interior side thereof, and the inner base is provided with a protrusion on an exterior side thereof; the protrusion engages the slot while the inner base is received in the outer base.

* * * * *